US006682308B1

(12) United States Patent
Fei et al.

(10) Patent No.: US 6,682,308 B1
(45) Date of Patent: Jan. 27, 2004

(54) FAN WITH ADJUSTABLE MOUNT

(75) Inventors: Siu Fei, Wan Chai (HK); Cho Woo, Hong Kong (HK); Walter G. Birdsell, Marlborough, MA (US)

(73) Assignee: Kaz, Inc., New York, NY (US)

( * ) Notice: Subject to any disclaimer, the term of this patent is extended or adjusted under 35 U.S.C. 154(b) by 0 days.

(21) Appl. No.: 10/210,796

(22) Filed: Aug. 1, 2002

(51) Int. Cl.[7] ..... F04D 29/64
(52) U.S. Cl. ..... 416/246; 415/213.1
(58) Field of Search ..... 415/126, 213.1; 416/205, 244 R, 246

(56) References Cited

U.S. PATENT DOCUMENTS

| | | | | |
|---|---|---|---|---|
| 2,100,923 A | | 4/1937 | Schmidt et al. | |
| D115,448 S | | 6/1939 | Park | |
| D154,703 S | | 8/1949 | Phillips | |
| 2,495,513 A | | 1/1950 | Doyle | |
| 2,795,388 A | * | 6/1957 | Myers | 248/125.1 |
| 2,813,673 A | * | 11/1957 | Smith | 417/361 |
| 2,857,095 A | | 10/1958 | Suarez Grau | |
| 2,933,273 A | | 4/1960 | Koch | |
| 3,072,321 A | | 1/1963 | King, Jr. | |
| 3,087,118 A | | 4/1963 | Goffstein | |
| 3,173,478 A | | 3/1965 | Maycen | |
| 3,405,894 A | * | 10/1968 | Jordan et al. | 248/662 |
| 3,782,853 A | | 1/1974 | Frister | |
| 3,846,042 A | | 11/1974 | Keene | |
| 3,860,361 A | | 1/1975 | McMurtry et al. | |
| 3,873,236 A | | 3/1975 | Gall | |
| 3,883,264 A | | 5/1975 | Rao | |
| 3,953,149 A | | 4/1976 | Henne | |
| 3,984,194 A | | 10/1976 | Fermer | |
| 4,061,441 A | | 12/1977 | Mejia | |
| 4,215,973 A | | 8/1980 | Saterdal | |
| 4,218,188 A | | 8/1980 | Saterdal | |
| 4,257,554 A | | 3/1981 | Willingham | |
| 4,319,866 A | | 3/1982 | Kolthoff | |
| 4,341,151 A | | 7/1982 | Sakamoto | |
| D270,941 S | | 10/1983 | Lin | |
| D273,416 S | | 4/1984 | Scotto | |
| D276,550 S | | 11/1984 | Kouno et al. | |
| 4,515,538 A | | 5/1985 | Shih | |
| D282,871 S | | 3/1986 | Hutter | |
| 4,630,999 A | | 12/1986 | De La Harpe | |

(List continued on next page.)

FOREIGN PATENT DOCUMENTS

| | | |
|---|---|---|
| EP | 310391 B1 | 5/1992 |
| EP | 733809 A1 | 9/1996 |
| EP | 1205668 A2 | 5/2002 |

OTHER PUBLICATIONS

Triangle Fans Master Breeze brochure (2pp.) dated Nov., 2000.

Lasko 18" High Velocity Pivoting Floor Fan with Quick Mount System brochure (2 pp.), dated Dec., 2001.

*Primary Examiner*—Ninh H. Nguyen
(74) *Attorney, Agent, or Firm*—Darby & Darby

(57) ABSTRACT

An adjustable fan assembly has a fan mount with an arcuate portion and a support member. The support member is moveable along the length of the arcuate portion of the fan mount to position the air flow from a fan mounted on the fan mount. The support member may also retract for compact storage.

18 Claims, 9 Drawing Sheets

U.S. PATENT DOCUMENTS 4,657,483 A 4/1987 Bede
D291,352 S 8/1987 Kouno et al.
4,729,725 A 3/1988 Markwardt
D295,070 S 4/1988 Shin-Chin
4,810,164 A 3/1989 Wright
4,850,804 A 7/1989 Huang
4,878,806 A 11/1989 Markwardt
D306,903 S 3/1990 Shin-Chin
D312,124 S 11/1990 Coup et al.
5,018,951 A 5/1991 Wang
5,033,711 A 7/1991 Gregorich et al.
5,110,263 A 5/1992 Chiu
D329,089 S 9/1992 Coup et al.
5,165,855 A 11/1992 Ricketts et al.
5,183,382 A 2/1993 Carroll
5,192,183 A 3/1993 Wilkinson
5,193,608 A 3/1993 Sekine et al.
5,195,869 A 3/1993 Groenhoff
5,197,854 A 3/1993 Jordan
5,232,090 A 8/1993 Raab et al.
5,244,347 A 9/1993 Gallivan et al.
5,266,004 A 11/1993 Tsumurai et al.
5,271,717 A 12/1993 Sato
5,297,617 A 3/1994 Herbert
5,297,936 A 3/1994 Sato
D346,440 S 4/1994 Chiu et al.
5,304,040 A 4/1994 Wang
D346,652 S 5/1994 Chiu et al.
D346,653 S 5/1994 Chiu et al.
5,326,225 A 7/1994 Gallivan et al.
5,336,049 A 8/1994 Herman
5,348,447 A 9/1994 Redetzke
5,368,262 A 11/1994 Garrity
D354,558 S 1/1995 Marvin et al.
5,391,056 A 2/1995 Wang
5,411,373 A 5/1995 Chiu et al.
D359,116 S 6/1995 Marvin et al.
5,431,544 A 7/1995 Hsu et al.
5,435,695 A 7/1995 Chiu et al.
5,435,696 A 7/1995 Cunning
5,445,215 A 8/1995 Herbert
5,460,485 A 10/1995 Sugiyama
5,480,282 A 1/1996 Matson
5,503,526 A 4/1996 Neils et al.
5,518,370 A 5/1996 Wang et al.
5,522,704 A 6/1996 Casteel
5,539,263 A 7/1996 Lee
5,547,343 A 8/1996 Jane et al.
D374,280 S 10/1996 Ediger et al.
5,567,117 A 10/1996 Gunn et al.
5,577,888 A 11/1996 Capdevila et al.
5,582,507 A 12/1996 Alizadeh
5,586,867 A 12/1996 Mehlos
5,599,162 A 2/1997 Ricketts et al.
5,609,473 A 3/1997 Litvin
5,611,667 A 3/1997 Nagamori et al.
5,613,833 A 3/1997 Wolfe et al.
5,616,004 A 4/1997 Alizadeh
5,621,846 A 4/1997 Smith et al.
5,624,230 A 4/1997 Taylor et al.
D380,043 S 6/1997 Chiu et al.
5,637,039 A 6/1997 Chiu et al.
5,658,195 A 8/1997 Marvin, Jr. et al.
5,667,731 A 9/1997 Junkel et al.
5,668,920 A 9/1997 Pelonis
D388,869 S 1/1998 Wang
5,742,107 A 4/1998 Asao et al.
5,743,709 A 4/1998 Jane et al.
5,752,688 A 5/1998 Campbell et al.
5,755,557 A 5/1998 Alizadeh
5,800,126 A 9/1998 Tsai
5,860,788 A 1/1999 Sorensen
5,927,947 A 7/1999 Botros
D413,664 S 9/1999 Keller et al.
6,000,910 A 12/1999 Ahn
RE36,514 E 1/2000 Clark
6,126,395 A 10/2000 Shingai
6,126,415 A 10/2000 Lasko
6,129,528 A 10/2000 Bradbury et al.
6,145,798 A 11/2000 Janisse et al.
6,160,956 A 12/2000 Pelonis
6,183,203 B1 2/2001 Grintz
6,196,802 B1 3/2001 Matsumoto
6,196,803 B1 3/2001 Hill et al.
6,203,279 B1 3/2001 Moody et al.
6,206,641 B1 3/2001 Park et al.
D441,068 S 4/2001 Bogazzi
6,210,101 B1 4/2001 Horng
6,237,884 B1 5/2001 Howe
6,244,821 B1 6/2001 Boyd
6,244,823 B1 6/2001 Marino et al.
6,283,709 B1 9/2001 Hill et al.
6,302,650 B1 10/2001 Williams et al.
6,336,793 B1 1/2002 Litvin
6,364,617 B1 4/2002 Riske et al.
6,375,440 B2 4/2002 Kosugi
6,386,828 B1 5/2002 Davis et al.

* cited by examiner

10/21(
5/9

FAN WITH ADJUSTABLE MOUNT

FIELD OF THE INVENTION

This invention relates to an adjustable mount for a fan.

BACKGROUND OF INVENTION

Many consumer fans are known in the industry. Fans of various shapes and sizes have been configured for use in different conditions and locations. For example, some fans oscillate or have speed, direction, and/or height adjustability. The present invention contemplates a fan which is aesthetically pleasing, easily adjustable, and compact for storage.

SUMMARY OF THE INVENTION

One illustrative embodiment of the present invention provides a fan assembly comprising a fan and a fan mount with a position-adjusting arcuate portion and a least one support member in which the fan is mounted. The support member is engaged with the position-adjusting arcuate portion such that the support member is fixedly positionable in at least two locations along a length of the arcuate portion of the fan mount.

The present invention may additionally comprise an adjustment mechanism to hold the support member in place with respect to the arcuate portion of the fan mount. The support member in the fan assembly of the present invention may also be selectively moveable to a retracted position and an extended position.

Another illustrative embodiment of the present invention provides a fan assembly comprising an arcuate tube with two ends, a fan supported by ends of the arcuate tube, and a support member having a tube-shaped collar including an opening that receives the arcuate tube so that the support member is adjustable in position along a length of the arcuate tube.

BRIEF DESCRIPTION OF THE DRAWINGS

Embodiments of the invention are described with reference to the following drawings, in which like numerals reference like elements, and wherein.

DETAILED DESCRIPTION

Illustrative embodiments of the present invention comprise a fan assembly having a fan that is adjustable in orientation. In one aspect of the invention, a fan mount includes an arcuate portion and a support member, such as a base that at least partially supports the fan assembly on a floor or other surface. The support member may be moved between a plurality of locations along the arcuate portion of the fan mount to support the fan in a number of orientations. Adjustment of the support member relative to the arcuate portion of the fan mount can allow a user to suitably orient the direction of air output by the fan. Moreover, adjustment of the support member in some embodiments can allow the fan assembly to be folded into a compact storage configuration.

In one aspect of the invention, the fan mount includes an arcuate portion and a support member which may move relative to each other. Adjustment of the support member with respect to the arcuate portion may result in a change in orientation of the fan relative to the support, thereby altering the direction that the fan outputs air when the fan assembly is supported by the support member. That is, since the fan may be fixed in at least one degree of freedom relative to the arcuate portion and since the arcuate portion is curved, positioning the support member at different locations on the arcuate member may change the orientation of the fan relative to the support member. Similarly the arcuate portion may be moved to different positions along the support member to adjust the orientation of the fan.

Figure 1:
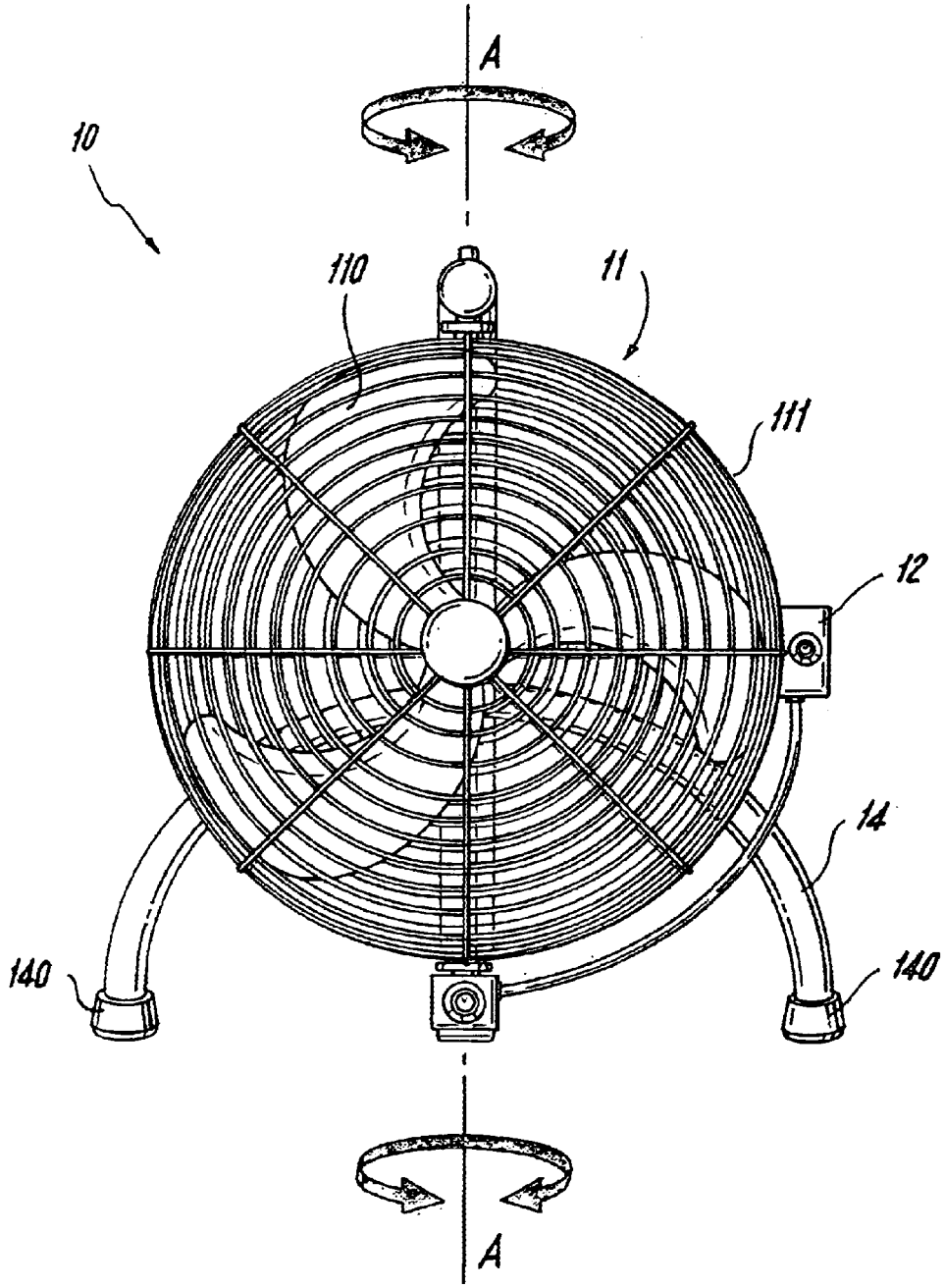
FIG. 1 is a front view of a fan assembly in accordance with the present invention.

FIGS. 1–11 show illustrative embodiments of a fan assembly that incorporate various aspects of the invention. As shown in FIG. 1, the fan assembly 10 comprises a fan 11, and at least one control 12. The fan 11 comprises fan blades 110, a grille 111, a motor and electronics required to rotate the fan blades (not shown). It should be understood, however, that the fan and its associated components may take any suitable form. Thus, the fan is not limited to a single axial type fan shown, but instead may be any suitable device for moving air, such as a fan that moves air via electrokinetics, an impeller or other means.

Figure 2:
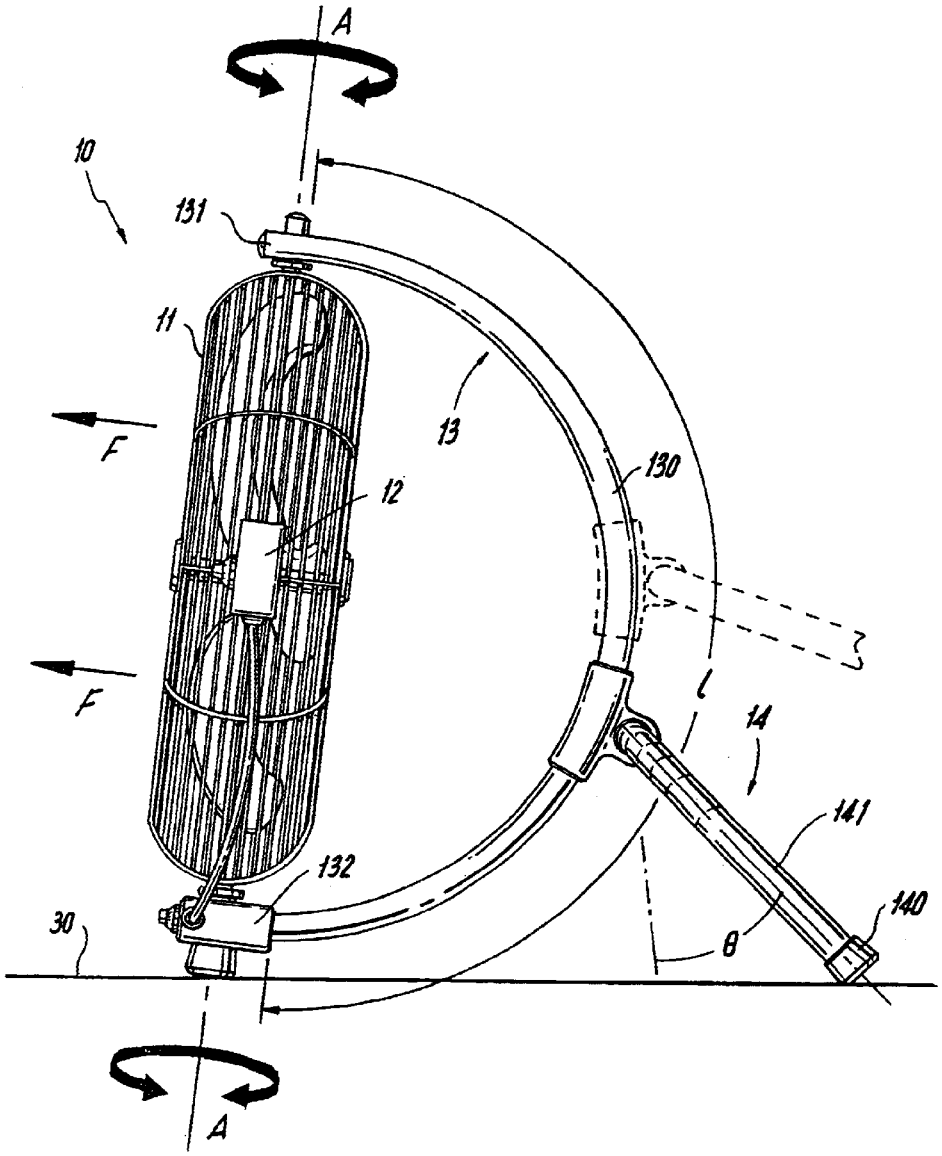
FIG. 2 is a side view of the FIG. 1 fan assembly.

As shown in FIG. 2, the fan assembly 10 additionally comprises a fan mount 13 that supports the fan at opposite ends 131 and 132. The fan mount 13 includes at least one support member 14. In this illustrative embodiment, the fan mount 13 has an arcuate portion 130, such as a bent tube, that engages with the fan at opposite ends 131 and 132. However, it should be understood that the arcuate portion 130 need not make up all or almost all of the fan mount 13, but instead may form any suitable portion of the fan mount 13. Thus, the fan mount 13 may have any suitable number of components and have any configuration for supporting the fan 11.

In this illustrative embodiment, the fan 11 may be configured to automatically oscillate about a rotational axis A—A in order to produce air flow across a wide area. Alternately, the fan 11 may be held stationary at any angular orientation about axis A—A. For example, the fan 11 may oscillate about axis A—A, and when the fan 11 achieves a desired angular orientation about axis A—A, a user may selectively retain the fan 11 in the desired angular orientation. Of course, those of skill in the art will appreciate that the fan may be arranged to oscillate around other, or additional, axes aside from axis A—A, or may be fixed in place on the fan mount 13 so it cannot oscillate.

In this illustrative embodiment, the arcuate portion 130 and support member 14 cooperate to support the fan assembly 10 on a surface 30, such as a floor or table top. However, the support member 14 may be arranged to support the fan assembly 10 itself on a surface 30 without the arcuate portion 130 contacting the surface 30. In either case, the fan mount 13 may position the fan 11 to achieve the desired air flow direction F from the fan 11. That is, in accordance with one aspect of the invention, the support member 14 may be moved relative to the arcuate portion 130 of the fan mount 13 to adjust the fan orientation.

Figure 3:
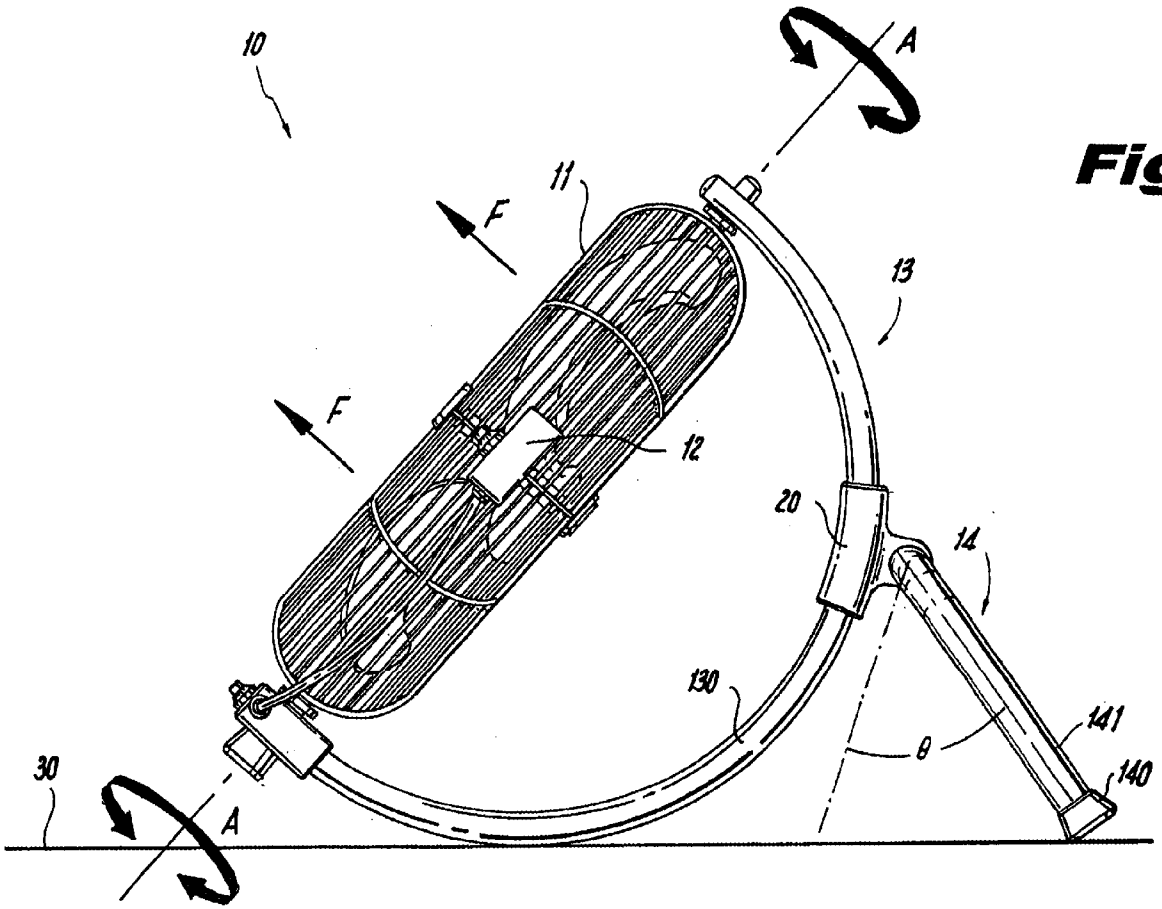
FIG. 3 is a side view of the fan assembly of FIG. 2 in an adjusted configuration.

In this illustrative embodiment, the arcuate portion 130 has a length l as measured along its longitudinal direction. That is, the length l of the arcuate portion 130 may be the arc length of the arcuate portion 130. As used herein, the longitudinal direction of the arcuate portion 130 is defined as the direction along the arc of the arcuate portion 130. As can be seen in FIGS. 2 and 3, the support member 14 may be movable with respect to the arcuate portion 130 in the longitudinal direction along its length. Specifically, FIG. 3 depicts the fan assembly 10 when the support member 14 is moved along the length l of the arcuate portion 130 to the position shown in dotted lines in FIG. 2. In this embodiment, adjustment of the support member 14 from the FIG. 2 position to the FIG. 3 position causes the fan 11 to blow air in a more upward direction.

The support member 14 may engage with the arcuate portion 130 in any suitable way, e.g., by way of an adjustment mechanism 60 that is on the support member, the arcuate portion 130 or part of both the support member 14 and arcuate portion 130. In the illustrative embodiment of FIG. 2, the adjustment mechanism 60 may include a coupler 20 that engages the arcuate portion 130. The coupler 20 may have an opening that receives the arcuate portion 130 and allows the coupler 20 to be selectively moved on the arcuate portion 130 to change the position of the support member 14. For example, the coupler 20 may include a tube portion that has an inner diameter larger than the outer diameter of the tube-shaped arcuate portion 130 so the arcuate portion 130 may be slidably received inside the coupler 20.

The adjustment mechanism 60 may position the support member 14 in any suitable way relative to the arcuate portion 130. For example, the adjustment mechanism 60 could allow the support member 14 to be positioned along a continuum of positions on the arcuate portion 130. FIGS. 2 and 3 show such an embodiment where the coupler 20 may frictionally engage with the arcuate portion 130 so the coupler 20 may be positioned at any location on the arcuate portion 130. Frictional engagement may be enhanced by providing an elastomeric sleeve or other material or device between the coupler 20 and the arcuate member 130.

Figure 4:
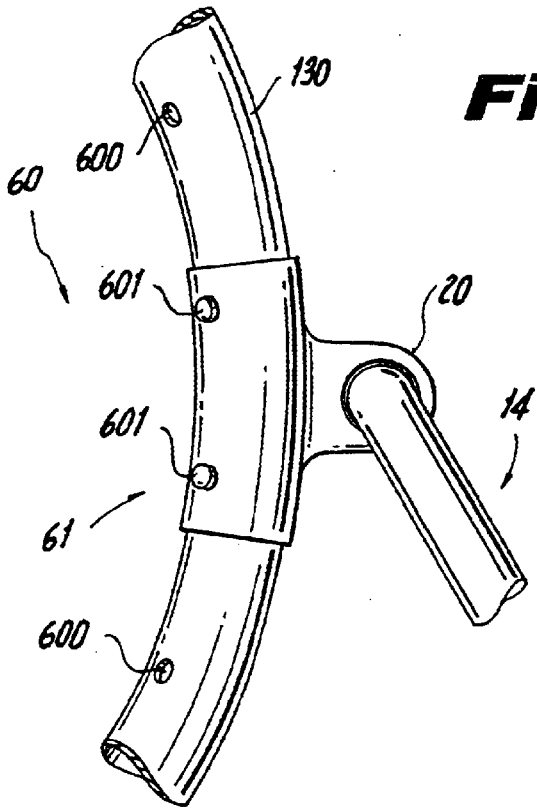
FIG. 4 is a side view of an adjustment mechanism in accordance with the present invention.
Figure 5:
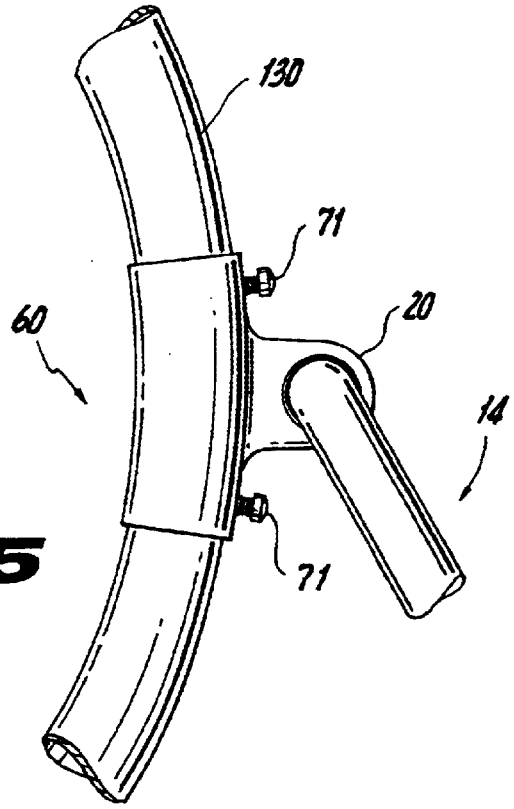
FIG. 5 is a side view of an alternative embodiment of an adjustment mechanism in accordance with the present invention.
Figure 6:
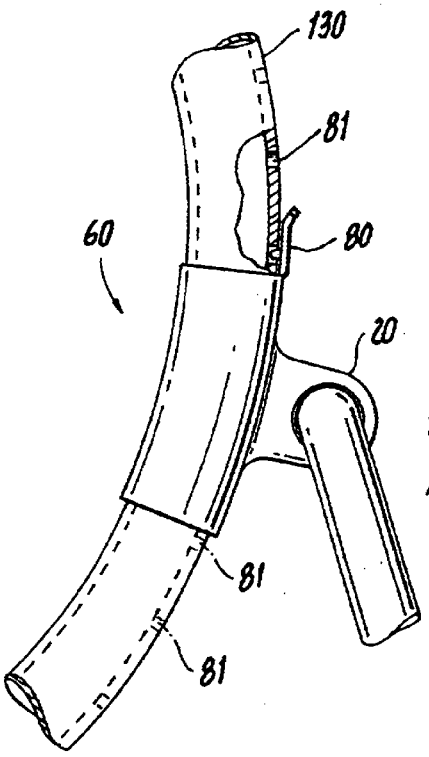
FIG. 6 is a side view of yet another alternative embodiment of an adjustment mechanism in accordance with the present invention.
Figure 7:
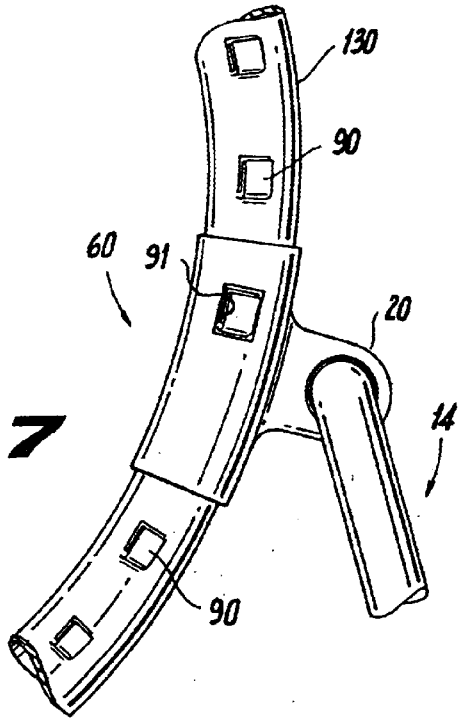
FIG. 7 is a side view of yet another embodiment of an adjustment mechanism in accordance with the present invention.

Alternately, the adjustment mechanism 60 could position the support member 14 at discrete indexed positions along the length of the arcuate portion 130. FIGS. 4–7 show several illustrative embodiments for such adjustment mechanisms 60. As shown in FIG. 4, the adjustment mechanism 60 may include an indexing element 61 with a series of holes 600 formed in the arcuate portion 130, at least one hole in the support member 14, and at least one pin 601 that engages with aligned holes in the arcuate portion 130 and the support member 14. Alternatively, as shown in FIG. 5, the support member 14 may have at least one hole (not shown) that receives at least one screw or set screw 71. In this embodiment, the arcuate portion 130 may have holes to receive the screw(s) 71 or the arcuate portion 130 could be solid and the screws tightened on the arcuate portion 130. As shown in FIG. 6, the indexing element 61 may comprise a biased member 80 (e.g., a spring finger and button) extending from the support member 14. The arcuate portion 130 may have a series of mating holes 81 sized and configured to receive at least a portion of the biased member 80, e.g., the button on the spring finger. In another embodiment of the present invention shown in FIG. 7, an arcuate portion 130 comprises a series of biased members 90 (e.g., spring-loaded buttons) each within a hole or other recess on the arcuate member 130. The biased members 90 may engage with a mating hole 91 in the coupler 20 to hold the support member 14 in place relative to the arcuate portion 130. Variations in the location, type, and number of the indexing elements 61 on the support member 14 and/or arcuate portion 130 are within the scope of the present invention. Alternatively, the support member 14 and arcuate portion 130 may be selectively positioned without the use of an indexing element 61. Other configurations are known in the art to keep arcuate portion 130 in place with respect to the support member 14.

Figure 8:
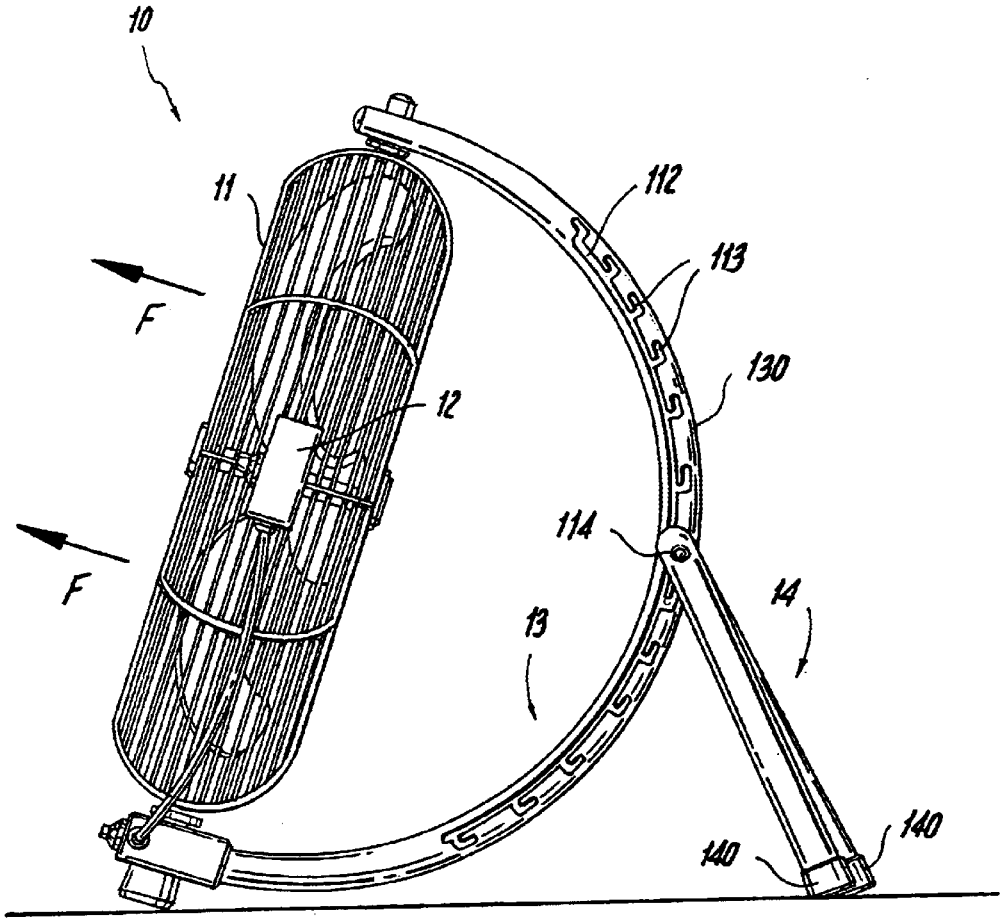
FIG. 8 is a side view of another embodiment of a fan assembly in accordance with the present invention.

Although FIGS. 4–7 depict a support member 14 comprising a coupler 20, the coupler 20 is optional and need not be used. That is, the support member 14 may be configured to retain a desired position along the length of the fan mount 13 in other ways. For example, as seen in FIG. 8, the arcuate portion 130 may comprise at least one channel 112. The channel 112 may have side channels 113 for a mating pin 114 connected to the support member 14 to slide. When the mating pin 114 rests in a side channel 113, the position of the support member 14 along the length of the arcuate portion 130 may be retained. Although the channel 112 extends through a fraction of the length of the arcuate portion 130 in FIG. 8, it will be apparent to one of skill in the art that the channel 112 may extend along a greater or lesser distance along the length of the arcuate portion 130 compared to that shown in FIG. 8. The support member 14 may alternatively retain a position along the length of the arcuate portion 130 by any other known means.

Figure 9:
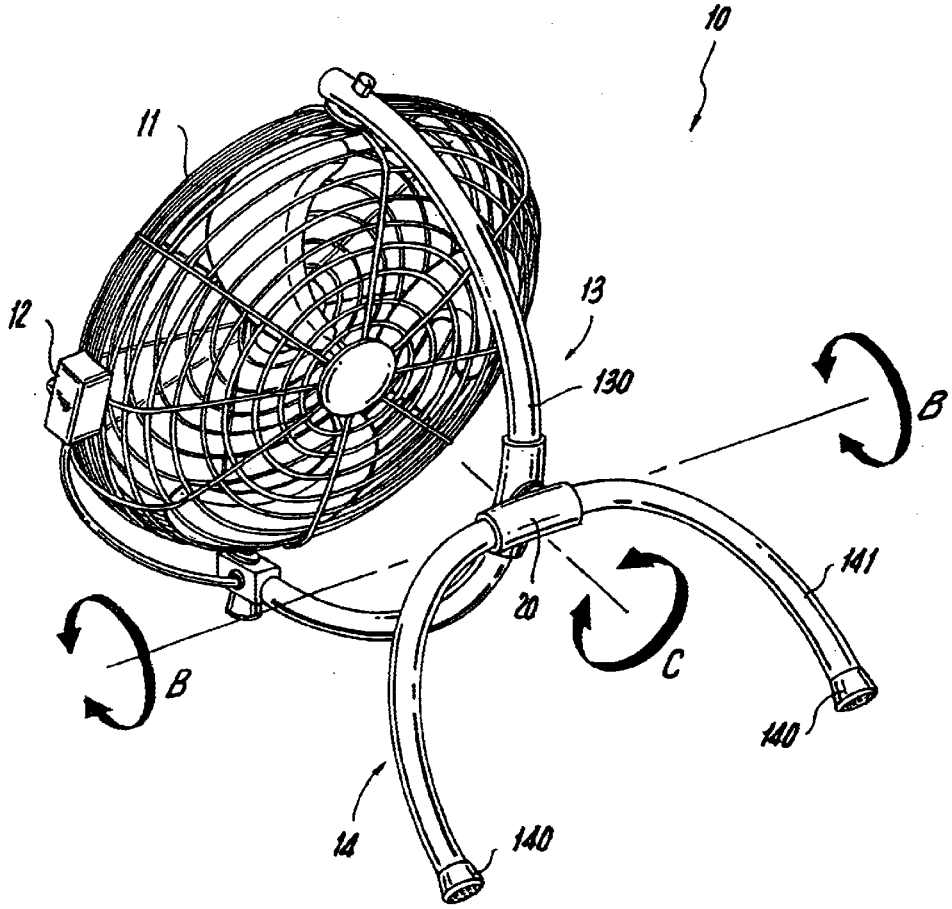
FIG. 9 is a rear perspective view of the FIG. 1 fan assembly.

In another aspect of the invention, the fan assembly may be moved between a normal operation arrangement and a retracted, or folded, configuration. As shown in FIG. 9, in one illustrative embodiment, at least part of the support member 14 may be rotated about an axis B—B relative to a coupler 20. When at least part of the support member 14 is rotated on axis B—B, it may be moved from an extended position as shown in FIG. 9 to a retracted position shown in FIG. 10 where the support member 14 is rotated in for storage. (The arcuate portion 130 of the fan mount 13 has also been optionally rotated relative to the fan 11 so at least part of the fan mount 13 is approximately coplanar with the fan 11.) Alternatively, part of the support member 14 may collapse, such as through a telescoping structure, for storage. Preferably, the retraction of at least part of the support member 14 may be accomplished without the use of a tool. Alternatively or additionally, as shown in FIG. 9, the support member 14 may rotate about an axis C—C relative to the arcuate portion 130. Rotation about axis C—C may allow the support member 14 to be aligned substantially coplanar with a substantial part of the fan mount 13 as shown in FIG. 11. In this case, the arcuate portion 130 of the fan mount 13 may be rotated relative to the fan 11 about the axis A—A so the fan 11 and fan mount 13 are compact and substantially coplanar for ease of storage. In one embodiment of this invention, the fan 11 and fan mount 13 are selectively lockable in the storage position shown in FIG. 11.

In one embodiment of the present invention, the support member 14 may have more than the two configurations (retracted and extended) described above. In addition to the extended and retracted positions, at least part of the support member 14 may additionally have a selectable angular position with respect to axis B—B as shown in FIG. 3. In this embodiment, when the support member 14 is moved along the length of the arcuate portion 130, at least part of the support member 14 may also rotate on axis B—B in order to support the fan mount 13 in the new configuration as seen in FIG. 3. Specifically, the angle of rotation $\phi$ is defined as the acute angle about B—B through which the support member 14 is rotated from the vertical. As the desired direction of flow F changes, the angle of rotation $\phi$ may be changed. Therefore, adjustments in the angle of rotation $\phi$ may be used in conjunction with adjustments in the longitudinal position of the support member 14 on the arcuate portion 130 in order to achieve the desired flow direction F.

As shown in FIGS. 2 and 3, one portion of the fan mount 13 may provide a part of the base for the fan assembly 10. In other words, one portion of the fan mount 13 may work in conjunction with the support member 14 in order to stabilize the fan assembly 10 while the fan 11 is in operation. For example, as shown in FIG. 2, a protrusion 135 on the fan mount 13 balances the fan assembly 10 with the support member 14. The support member 14 could include a curved bar 141 whose ends contact the surface 30 the fan is on to support the fan assembly 10. As will be appreciated by those of skill in the art, although the support member 14 in some illustrative embodiments includes a coupler 20 and a single curved bar 141, other configurations may be used. For example, the support member 14 may include multiple legs or other parts, a single, monolithic structure or stand, or other arrangements to support the fan assembly 10. The support member 14 may additionally comprise high-friction members 140 in the area(s) where the support member 14 contacts the surface 30 that the fan assembly 10 rests on. For example, the high friction members 140 may be rubberized caps.

In operation, a user may change the direction of airflow F created by the fan 11. Specifically, a user may change the airflow direction F by moving the support member 14 a desired distance along the length of the arcuate portion 130 of the fan mount 13. Once the support member 14 is in the desired longitudinal location with respect to the arcuate portion 130, the user may secure the support member 14 to retain the desired position. In one embodiment of the present invention, a user could also rotate the support member 14 about axis B—B through an angle $\phi$ in order to obtain the desired air flow direction F.

A user may then use the control 12 to cause the fan blades 110 to rotate at a desired speed, thus producing air flow in the desired air flow direction F. In one embodiment, a user could opt to have the fan automatically oscillate about axis A—A and/or other axes. Alternatively or additionally, a user could position the fan 11 in a desired angular orientation about axis A—A to create substantially unidirectional airflow in a desired direction.

Figure 10:
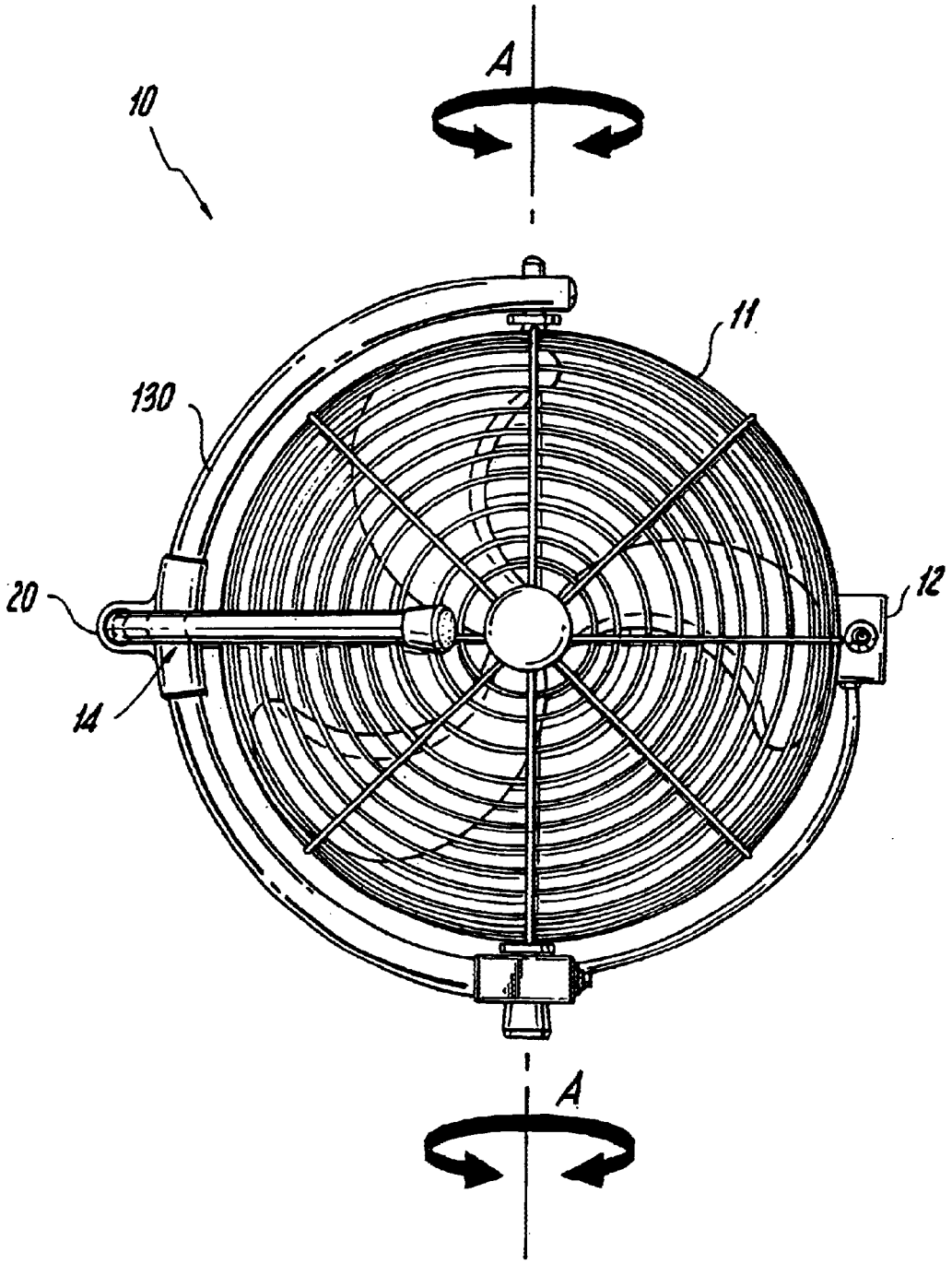
FIG. 10 is a front view of a fan assembly in a retracted position in accordance with the present invention.
Figure 11:
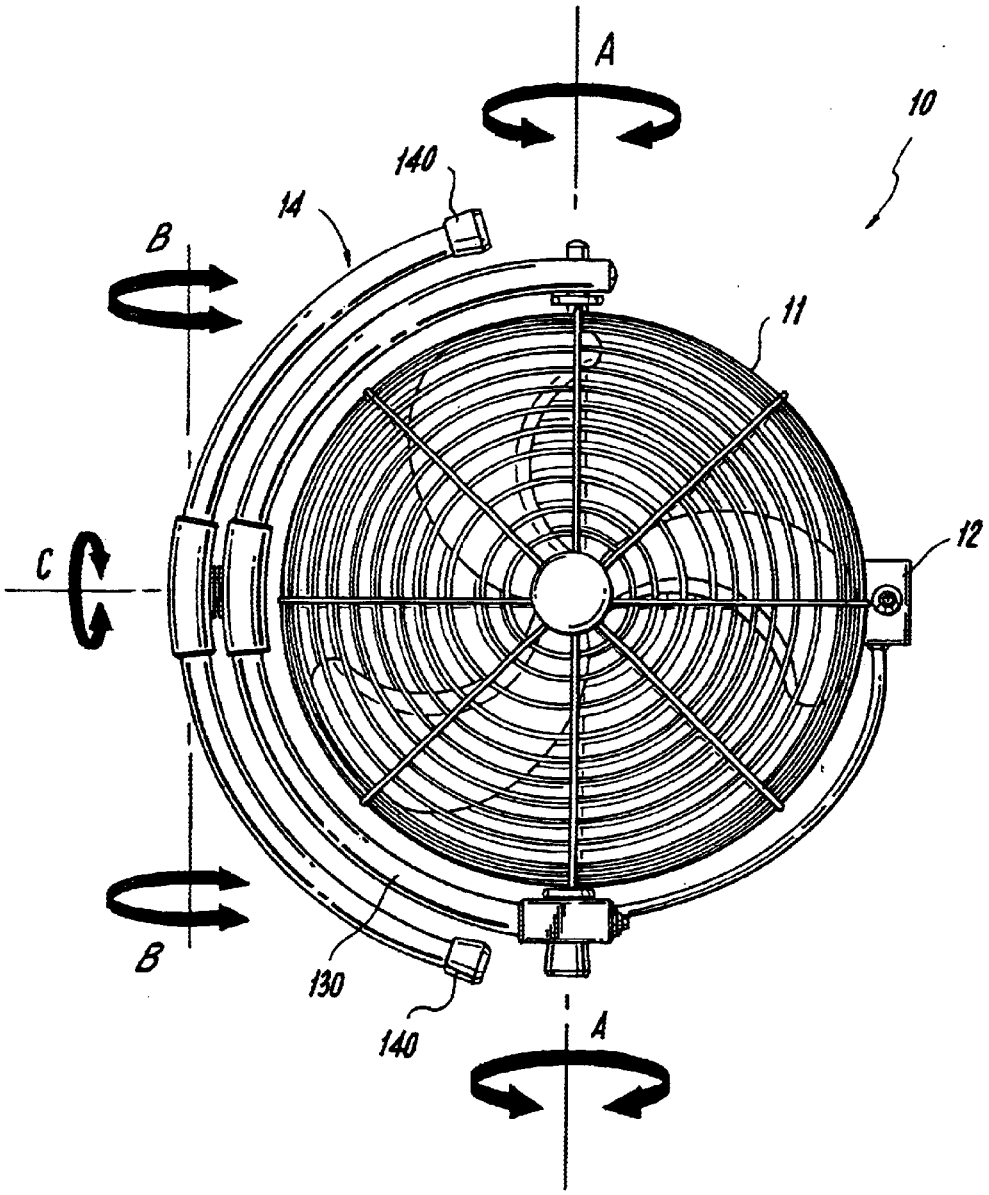
FIG. 11 is a front view of a fan assembly in a storage position in accordance with the present invention.

When the fan is no longer needed, a user could turn off the fan using the control 12 and rotate the fan 11 so that the fan 11 is substantially coplanar with at least a portion of the fan mount 13 as shown in FIGS. 10 and 11. Additionally, in one embodiment the user could rotate at least a portion of the support member 14 along axis B—B in order to put the support member 14 in a storage position as shown in FIG. 10. In yet another embodiment, a user could also rotate at least a portion of the support member 14 about axis C—C relative to the arcuate portion 130 of the fan mount 13 in order to make the fan 11 and at least part of the fan mount 13 substantially coplanar for storage (and/or to provide a convenient carrying handle) as shown in FIG. 11. The user may additionally be able to secure the components of the fan assembly 10 in the storage position shown in FIG. 11.

As shown by the accompanying Figures, the present configuration provides a low profile utility fan which is capable of being positioned in many ways. Particularly, because the fan may be selectively positionable to an angular orientation about axis A—A, and the support member 14 may be moved along the length of the arcuate portion 130 of the fan mount 13, the fan can provide substantially unidirectional flow in one of a plurality of directions. Additionally, since the fan 11 may also oscillate about axis A—A, the fan assembly is capable of providing multidirectional air movement across large areas.

Having described certain embodiments of the present invention, various alterations, modifications, and improvements will readily occur to those skilled in the art. It should be understood that positions of the fan may be provided in a variety of ways and using different devices than those shown in the illustrative embodiment described above. Therefore, such alterations, modifications and improvements are intended to be within the spirit and scope of the invention. Accordingly, the foregoing description is by way of example only, and not intended to be limiting.

What is claimed is:

1. A fan assembly, comprising:

a fan; and a fan mount with an elongated position-adjusting arcuate portion, the arcuate portion having two opposed ends, and said fan pivotally mounted to said fan mount between said opposed ends thereby defining a rotation axis for the fan; and at least one support member engaged with said position-adjusting arcuate portion such that the support member is fixedly positionable in at least two locations along a length of the arcuate portion.

2. The fan assembly of claim 1, wherein said support member is selectively movable between a retracted position and an extended position.

3. The fan assembly of claim 2, wherein said support member is selectively movable without the use of tools.

4. The fan assembly of claim 1, wherein said arcuate portion of said fan mount has two substantially diametrically opposed ends, and said fan is mounted to said fan mount between said substantially diametrically opposed ends.

5. The fan assembly of claim 1, wherein said fan is selectively positionable at a plurality of locations about said rotation axis.

6. The fan assembly of claim 5, further comprising means for retaining said support member in a desired location along a length of the arcuate portion of the fan mount.

7. The fan assembly of claim 1, wherein at least one part of said fan mount together with the at least one support member support said fan assembly on a surface.

8. The fan assembly of claim 1, further comprising an adjustment mechanism to hold said support member in place with respect to said arcuate portion of said fan mount.

9. The fan assembly of claim 8, wherein said adjustment mechanism comprises a coupler that interconnects the support member and the arcuate portion.

10. The fan assembly of claim 1, wherein said support member includes at least two legs.

11. The fan assembly of claim 10, wherein said at least two legs together form an arcuate shape.

12. The fan assembly of claim 1, wherein the arcuate portion is pivotally mounted to said fan.

13. A fan mounting assembly, comprising:

a mounting member with an arcuate portion defining a longitudinal direction along said mounting member, wherein said mounting member is configured to mount a fan and the arcuate portion is constructed and arranged to support the assembly by contacting a horizontal surface separate from the fan mounting assembly; and at least one support connected to said mounting member, constructed and arranged such that said at least one support is moveable along said longitudinal direction of said arcuate portion.

14. A fan assembly, comprising:

an arcuate tube with two ends;

a fan supported by at least one end of said arcuate tube; and a support member having a tube-shaped collar including an opening that receives said arcuate tube so that said support member is adjustable in position along a length of said arcuate tube, said support member being movable along said arcuate tube relative to the fan.

15. The fan assembly of claim 14, wherein the support member comprises a coupler that includes the opening that receives the arcuate tube.

16. The fan assembly of claim 14, wherein the support member includes a curved bar having opposite ends arranged to contact a surface and support the fan assembly.

17. The fan assembly of claim 14, wherein a portion of the arcuate tube is arranged to contact a surface to support the fan assembly together with the support member.

18. The fan assembly of claim 14, wherein the fan is supported by two ends of said arcuate tube.

* * * * *